US005270507A

United States Patent [19]

Nakamura et al.

[11] Patent Number: 5,270,507

[45] Date of Patent: Dec. 14, 1993

[54] PUSH BUTTON SWITCH AND METHOD FOR MANUFACTURING SAME

[75] Inventors: Akio Nakamura, Saitama; Yoshitsugu Morikawa, Tokyo; Mikio Kiyosawa, Nagano, all of Japan

[73] Assignee: Shin-Etsu Polymer Co., Ltd., Japan

[21] Appl. No.: 722,876

[22] Filed: Jun. 28, 1991

Related U.S. Application Data

[63] Continuation-in-part of Ser. No. 466,675, Jan. 17, 1990, abandoned.

[30] Foreign Application Priority Data

Jan. 19, 1989 [JP] Japan ..... 1-8525

[51] Int. Cl.[5] ..... H01H 1/02

[52] U.S. Cl. ..... 200/511; 200/512; 200/514

[58] Field of Search ..... 204/511, 512, 514; 264/129, 132, 78; 156/277; 524/430; 428/415; 101/35

[56] References Cited

U.S. PATENT DOCUMENTS

| | | | |
|---|---|---|---|
| 2,404,073 | 7/1946 | Karfiol et al. | 264/132 |
| 2,571,962 | 10/1951 | Smith et al. | 264/132 |
| 2,722,038 | 11/1955 | Freund | 264/132 |
| 2,874,416 | 2/1959 | Burnett | 264/132 |
| 3,860,388 | 1/1975 | Haigh | 264/129 |
| 4,800,243 | 1/1989 | Osawa et al. | 200/514 |
| 4,980,221 | 12/1990 | Kobayashi et al. | 101/35 |

FOREIGN PATENT DOCUMENTS

| | | | |
|---|---|---|---|
| 0109384 | 6/1984 | Japan | 264/129 |
| 61-225721 | 10/1986 | Japan . | |
| 62-93811 | 4/1987 | Japan . | |

*Primary Examiner*—Henry J. Recla
*Assistant Examiner*—David J. Walczak
*Attorney, Agent, or Firm*—Lerner, David, Littenberg, Krumholz & Mentlik

[57] ABSTRACT

A push button switch and methods for manufacturing the same result in increased manufacturing efficiency and increased design freedom. The push button switch includes a key top, a dome section and a leg section which are integrally formed from a silicone rubber material. The key top includes a colored section formed by penetrating the coloring dye of a dye impregnated ink below the upper surface of the key top. The push button switches are formed into a rubber cover configuration by charging a mold for forming a plurality of the push button switches with a silicone rubber material. The dye impregnated ink is then applied onto the surface of each of the key tops by either a wet printing process or a sublimation transfer technique, and is subjected to a heat treatment which causes the dye to penetrate into each of the key tops.

32 Claims, 3 Drawing Sheets

PUSH BUTTON SWITCH AND METHOD FOR MANUFACTURING SAME

CROSS-REFERENCE TO RELATED APPLICATIONS

This is a continuation-in-part application of U.S. patent application Ser. No. 7/466,675, filed Jan. 17, 1990, now abandoned.

FIELD OF THE INVENTION

This invention relates to a push button switch and a method for manufacturing the same, and more particularly to a push button switch integrally made of rubber and adapted to manually operate the electric circuit of various kinds of electrical and electronic appliances, as well as a method for manufacturing such switch.

BACKGROUND OF THE INVENTION

A push button switch is conventionally used for operating an electric circuit in a variety of electric and electronic appliances such as electronic calculators, telephones, personal computers, wordprocessors and remote control devices for various appliances. In the prior art, keypads having a plurality of push button switches have been simultaneously and integrally formed from a rubber material such as silicone rubber or the like. Each of these push button switches includes a key top formed from a plastic material which is fitted on the surface of the keypad. Recently, the plastic key top has been replaced with a key top formed from a rubber material in order to improve the appearance, design and feel of the push button switch.

Such rubber key tops are generally made in such a manner that a plurality of the rubber key tops, to which several colors such as red, blue, yellow and the like are applied, are arranged in a single rubber cover. For example, when the push button switch is used for an electronic calculator, a remote control device or the like, twenty to thirty rubber push button keys are integrally formed so as to cover a printed circuit board having a pectinate electrode pattern. For this reason, the plurality of rubber push button switches are referred to as a rubber cover switch in the lump. Alternatively, the rubber key top may be constructed so as to act as a display key top on which a desired pattern is provided, such as a letter or the like.

The above-described conventional colored key tops are made by arranging a rubber compound, blended with a pigment of a predetermined color, on a predetermined surface portion of the key top in a tessellate pattern and subjecting it to a pressing operation. Unfortunately, the blending of the rubber compound with the pigment causes the coloration of the key tops in each production lot to be highly troublesome. In addition, the conventional manufacturing process causes the rubber material to flow out of the predetermined surface section of the key top during the pressing operation, resulting in defects such as the dislocation of the pattern or the like. This not only leads to the push button switches having an inferior appearance and decreased productivity, but to a decreased degree of design freedom as well.

A pattern such as a letter or the like provided on the key top is generally formed by applying a rubber ink blended with a coloring pigment onto the surface of the key top by wet printing, such as screen printing or intaglio printing, to form a pattern which projects from the key top by a predetermined thickness. Screen printing leads to the formation of a pattern having a thickness of 10–20 um, whereas the intaglio offset printing results in a pattern having a thickness of 1–10 um. Whether screen printing or intaglio offset printing is selected depends upon the strength of adherence of the rubber ink on the key top and the resistance to wear of the rubber ink. Unfortunately, the pattern formed using the rubber ink does not exhibit good wear resistance. Therefore, when the key top is tapped or touched repeatedly, the projecting pattern is worn or damaged, thereby reducing the durability of the push button switch.

Accordingly, it would be highly desirable to develop a push button switch which is capable of being manufactured with improved productivity and which enables an increased degree of freedom in selecting the design formed thereon.

SUMMARY OF THE INVENTION

One aspect of the present invention provides a push button switch having a key top, a dome section and a leg section which are integrally formed from a silicone rubber material. The key top includes a colored section formed by penetrating the coloring dye of a dye impregnated ink into the interior of the key top by one of the preferred processes of the present invention.

In one preferred embodiment of the present invention, the colored section of the key top is formed by a wet printing process. The dye impregnated ink for use in this process comprises between about 10 wt % and about 30 wt % of a sublimation dye selected from the group consisting of anthraquinone dyes, azo dyes and mixtures thereof, between about 40 wt % and about 70 wt % of a vehicle resin comprising a silicone resin, and between about 10 wt % and about 40 wt % of a solvent for dissolving the vehicle resin. The dye impregnated ink is applied to either the entire surface or a select portion of the surface of the key top by a wet printing process, and is then subjected to a heat treatment process which results in the sublimation dye penetrating below the surface of the key top. The heat treatment process is conducted at a temperature between about 160° C. and about 220° C. for between about 10 minutes and about 30 minutes.

In preferred embodiments of this process, the dye impregnated ink includes between about 15 wt % and about 25 wt % of the sublimation dye, between about 50 wt % and about 60 wt % of the vehicle resin, and between about 20 wt % and about 30 wt % of the solvent. In more preferred embodiments of this process, the heat treatment process is conducted at a temperature between about 180° C. and about 200° C. for between about 10 minutes and about 15 minutes.

In highly preferred embodiments of this process, at least a portion of the vehicle resin is selected from the group consisting of polyorganosiloxane, vinylsilicone resin, vinylsilicone oil, and mixtures thereof.

In another preferred embodiment of the present invention, the colored section of the key top is formed by a sublimation transfer technique. The dye impregnated ink for use in this process comprises between about 1 wt % and about 15 wt % of a sublimation dye, between about 3 wt % and about 30 wt % of a vehicle resin selected from the group consisting of cellulose resins, alkyd resins, water-soluble acrylic resins, polyvinyl alcohols, polyamide resins, silicone resins, and mixtures thereof, and between about 70 wt % and about 95 wt % of a solvent for dissolving the vehicle resin. In accordance with this process, the dye impregnated ink is applied to a sublimation transfer sheet and dried to form a film adhered thereto, which film is then contacted with the surface of the key top while the sublimation transfer sheet is subjected to a heat treatment process which results in the sublimation dye penetrating below the surface of the key top. The heat treatment process is conducted at a temperature between about 150° C. and about 230° C., at a pressure between about 0.1 kgf/cm$^2$ and about 1.0 kgf/cm$^2$ and for a time between about 15 seconds and about 5 minutes.

In a preferred embodiment of this process, the dye impregnated ink includes between about 3 wt % and about 10 wt % of the sublimation dye, between about 5 wt % and about 15 wt % of the vehicle resin, and between about 80 wt % and about 90 wt % of the solvent. In more preferred embodiments of this process, the heat treatment process is conducted at a temperature between about 180° C. and about 220° C., at a pressure between about 0.1 kgf/cm$^2$ and about 0.2 kgf/cm$^2$ and for a time between about 20 seconds and about 60 seconds.

Accordingly, it is an object of the present invention to provide a push button switch which is capable of improved productivity and production efficiency.

It is another object of the present invention to provide a push button switch in which there is a greater degree of freedom in selecting the design formed thereon.

It is a further object of the present invention to provide a push button switch which may be economically manufactured in varying designs in small lot sizes.

It is still another object of the present invention to provide a push button switch which exhibits a good appearance.

It is yet another object of the present invention to provide a method for manufacturing a push button switch with improved production efficiency.

It is a still further object of the present invention to provide a method for manufacturing a push button switch at a low cost.

It is yet a further object of the present invention to provide a method for economically manufacturing a push button switch in a variety of designs in small lot sizes.

Still other objects and advantages of the present invention will in part be obvious and will in part be apparent from the specification.

The invention accordingly comprises the features of construction, combination of elements and arrangement of parts, and several steps and the relation of one or more such steps with respect to each of the other, all as exemplified in the following detailed disclosure, and the scope of the invention will be indicated in the claims.

BRIEF DESCRIPTION OF THE DRAWINGS

A more complete appreciation of the subject matter of the present invention and the various advantages thereof can be realized by reference to the following detailed description, in which reference is made to the accompanying drawings in which like reference numerals designate like or corresponding parts throughout, and wherein.

DETAILED DESCRIPTION OF THE PREFERRED EMBODIMENTS

Figure 1:
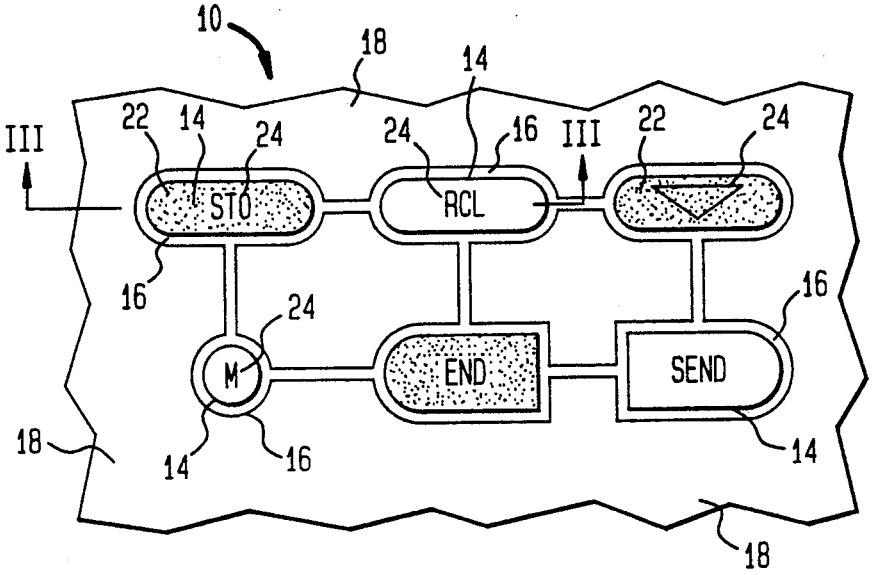
FIG. 1 is a fragmentary plan view showing an embodiment of a push button switch in accordance with the present invention.

One preferred embodiment of a push button switch in accordance with the present invention is shown generally at 10 in FIGS. 1-3B. Although push button switch 10 is shown as a plurality of push button keys formed integrally with one another, the present invention contemplates the formation of a push button switch having a single key. Each key of push button switch 10 includes a key top 14, a dome section 16 connected to the outer periphery of the bottom portion of the key top 14, and a leg section 18 connected to the dome section 16, all of which elements may be formed from a rubber material so as to be integral with one another. The key top 14 is provided on the bottom surface thereof with a conductive contact 20 which is disposed opposite to a fixed contact 21 so as to serve as a moveable contact. The key top 14 includes a colored section 22 formed therein by carrying out the wet printing or heat transfer of a dye impregnated ink onto the upper surface of the key top 14 so that the dye contained in the ink penetrates into the interior of the key top 14 in addition to being deposited on its upper surface.

The key top may be preformed from a transparent or semi-transparent rubber material of any achromatic color, such as white, gray or the like, or any chromatic color, and then colored by applying the dye impregnated ink onto at least a part of the upper surface of the key top 14 by wet printing or heat transfer so that the coloring dye penetrates into the interior of the key top. The rubber material used may also be colorless. Alternatively, the coloring may be carried out by previously coloring the key top, or preforming the key top from any colored or colorless rubber material and then applying any pattern 24, such as a letter, figure, symbol or the like, in the dye impregnated ink on the upper surface of the key top so that the pattern penetrates therein.

Rubber materials used to form key tops typically include natural rubber (NR) , isoprene rubber (IR), butadiene rubber (BR), styrene-butadiene rubber (SBR), chloroprene rubber (CR), isoprene-isobutylene rubber (IIR), ethylene-proprene rubber (EPR, EPDM), urethane rubber, polyester elastomer and the like. The key tops 14 of the present invention, however, preferably are formed from a silicone rubber. The key tops and dome sections of a plurality of keys may be integrally formed into a configuration like a rubber cover by compression molding or injection molding. Further, the two-color forming of the conductive rubber contact element 20 may also be carried out by compression molding or injection molding.

Dyes suitable for use in the dye impregnated ink include sublimation dyes adapted to carry out sublimation, vaporization or migration due to diffusion when they are subjected to any heat treatment. For this purpose, sublimation dyes which exhibit colors such as yellow, orange, red, purple, blue or the like may be used. Such dyes include, for example, nitro dyes, azo dyes, quinophthalone dyes, anthroquinone dyes or the like. The selected dye is then dissolved in a binder solution to obtain the dye impregnated ink. The binder solution may be prepared from a vehicle resin and a solvent for dissolving the resin. Vehicle resins suitable for use in the preparation of the binder solution include those which do not have any affinity for each of the above-described dyes and which do not prevent the sublimation, vaporization or migration of the dye. Suitable materials which may be used for this purpose include cellulose resins such as ethyl cellulose, hydroxyethyl cellulose and cellulose acetate propionate; alkyd resins; water-soluble acrylic resins; polyvinyl alcohol, polyamide resins; silicone resins such as polyorganosiloxane, vinylsilicone resin and vinyl silicone oil; and the like. Solvents suitable for use in the binder solution include benzotriazole, ethyl alcohol, isopropyl alcohol (IPA), toluene, xylene, ethyl acetate, ethyl cellosolve, butyl cellosolve, water and mixtures thereof. The particular vehicle resins and solvents which make up the binder solution will depend upon the particular technique employed for applying the dye impregnated ink to the key tops of the push button switches, as will be discussed more fully below.

The sublimation dyes described above generally have a molecular weight in the range of from 230 to 380 and a chemical structure suitably possessing a polar group such as a hydroxl group (—OH), an amino group ($—NH_2$), a nitro group ($—NO_2$), a sulfonyl group ($—SO_2$), a methoxyl group ($—OCH_3$) or the like. In general, it is considered that such dyes concurrently carry out sublimation, vaporization and melting within a temperature range of about 150° C. to 230° C., resulting in migration by diffusion. The dyes may be indicated by Color Index. For instance, such sublimation dyes typically include nitro dyes of, for example, Color Index Disperse Yellow 1 (yellow) , Color Index Disperse Orange 15 (orange) and the like; azo dyes of, for example, Color Index Disperse Yellow 3 (yellow) , Color Index Disperse Orange 3 (orange) , Color Index Disperse Red 17 (red) , Color Index Disperse Violet (violet) and the like; quinophthalone dyes of, for example, Color Index Disperse Yellow 54 (yellow) and the like; and anthroquinone dyes of, for example, Color Index Disperse Yellow 13 (yellow) , Color Index Disperse Red 4 (red) , Color Index Disperse Violet 4 (violet), Color Index Disperse Blue 3 (blue) and the like.

Figure 2:
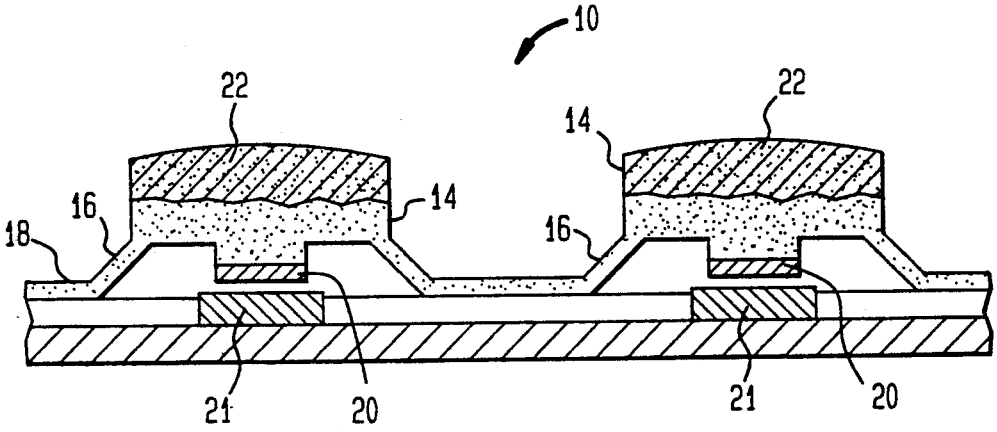
FIG. 2 is a fragmentary vertical sectional view of the push button switch shown in FIG. 1.
Figure 3A:
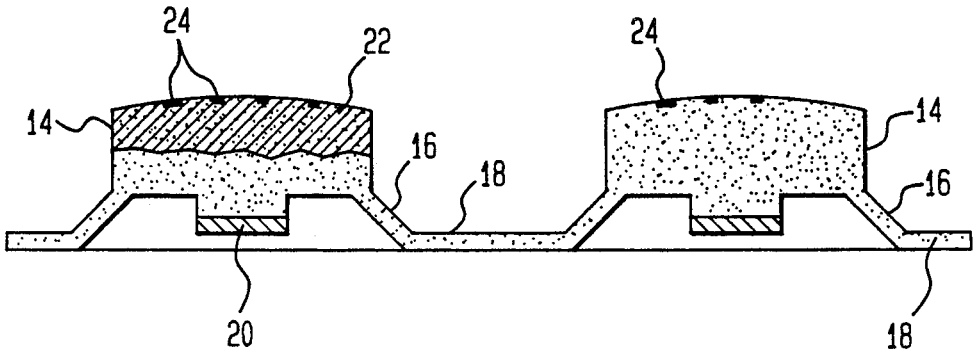
FIG. 3A is a fragmentary vertical sectional view taken along line III—III of FIG. 1.
Figure 3B:
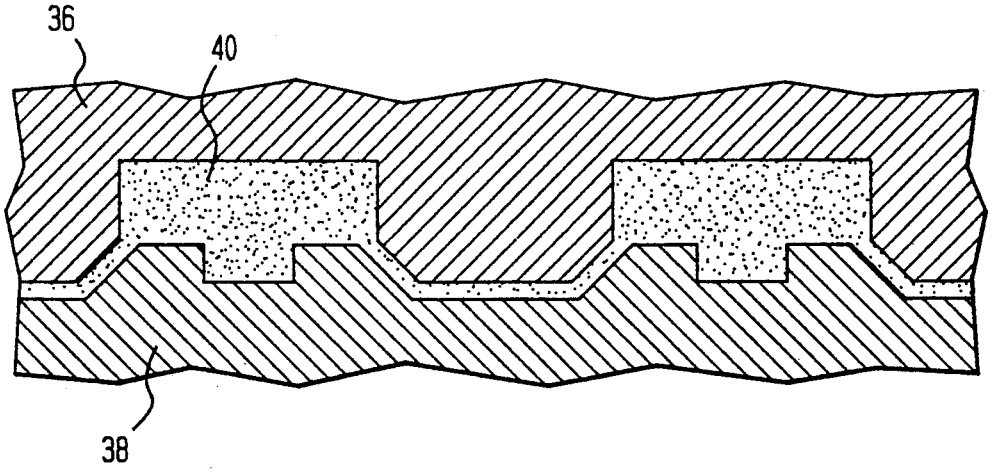
FIG. 3B is a fragmentary vertical sectional view showing the molding of the push button switch shown in FIG. 1 using mold means.

In accordance with one method of the present invention, a plurality of the push button switches 10, each comprising key top 14, dome section 16 and leg section 18, as shown in FIGS. 2 and 3A, are integrally formed into a configuration like a rubber cover by charging a mold with a silicone rubber material. For this purpose, the integral molding of the push button switches may be carried out using a mold as shown in FIG. 3B. In FIG. 3B, the mold comprises two mold halves 36 and 38 and is charged with a silicone rubber material 40.

Once molded, a dye impregnated ink may be applied directly onto the upper surface of the key top 14 of each push button switch 10 by a wet printing process, such as screen printing, intaglio offset printing or the like. In wet printing, the dye impregnated ink may be used in the form of a liquid. The ink may be applied over at least a part of the upper surface of the key top 14 or in a desired pattern thereon, such as a letter, a figure, a symbol or the like.

Dye impregnated inks for use in wet printing processes preferably include between about 10 wt % and about 30 wt % of a sublimation dye, and more preferably between about 15 wt % and about 25 wt % of such dye. The binder solution for such inks preferably comprises between about 40 wt % and about 70 wt % of a vehicle resin in the form of a silicone resin, and more preferably between about 50 wt % and about 60 wt % of such vehicle resin. Preferably, at least a portion of the silicone resin includes polyorganosiloxane, vinylsilicone resin vinylsilicone oil or mixtures thereof. The binder solutions also preferably include between about 10 wt % and about 40 wt % of a solvent consisting of benzotriazole, ethanol, toluene or mixtures thereof, and more preferably between about 20 wt % and about 30 wt % of such solvent. By forming the key tops from silicone rubber and using a silicone resin as the vehicle resin in the dye impregnated ink applied thereto, a deeper penetration of the sublimation dye within the key tops is obtained. One explanation for this is that the intermolecular force of a siloxane-bond chain is smaller than that typically found in plastics, and therefore, the basic spiral conformation of the silicone polymer is bulky, with the result that the dye is able to penetrate more deeply therein. For example, penetration depths between about 5 mm and about 10 mm have been obtained in silicone rubber key tops with dye impregnated inks having the aforementioned composition.

After being applied to the key top, the ink is subjected to a heat treatment within a temperature range of from about 100° C. to about 300° C., preferably from about 160° C. to about 220° C., and more preferably from about 180° C. to about 200° C., and for a period of time from about 0.5 second to about 30 minutes, preferably from about 10 minutes to about 30 minutes, and more preferably from about 10 minutes to about 15 minutes, so that the ink penetrates into and colors the key top, including its upper surface. The penetration may be carried out at a pressure of 0 $kgf/cm^2$. The degree to which the ink penetrates into the key top 14 varies depending upon the amount of ink applied. For example, when the ink is applied in a relatively large amount onto the key top 14, it may impregnate throughout the entire key top 14; whereas the application of the ink in a small amount causes it to penetrate only the upper surface of the key top and the interior portion in close proximity thereto. After heat treatment, should any of the vehicle resin from the dye impregnated ink remain on the surface of the key top, it is not necessary to employ a solvent to wipe the resin therefrom since such resin will form a hard surface on the key tops. This surface layer will not easily peel away from the rubber key top material since both the resin and the key tops are made from a silicone material and strongly adhere to one another.

The present invention also permits a colored pattern 24, such as a letter, figure, symbol or the like, to be formed on the upper surface of the colored key top 14 by applying an appropriate dye impregnated ink on the surface by wet printing in the desired pattern and then subjecting it to a heat treatment such as set forth above.

When the key top 14 is wholly colored according to the above-described direct wet printing process, the dye impregnated ink may be applied to the entire upper surface of the key top and then subjected to the heat treatment. Alternatively, the ink may be coated on only a part of the upper surface of the key top, or a pattern may be formed on the upper surface of the key top by wet printing, followed by the heat treatment. This results in the penetration of the pattern into the key top 14 while the upper surface of the key top is kept smooth. However, excessive time and/or temperature in the heat treatment for forming the pattern often causes the pattern to become faded or obscure.

Figure 4:
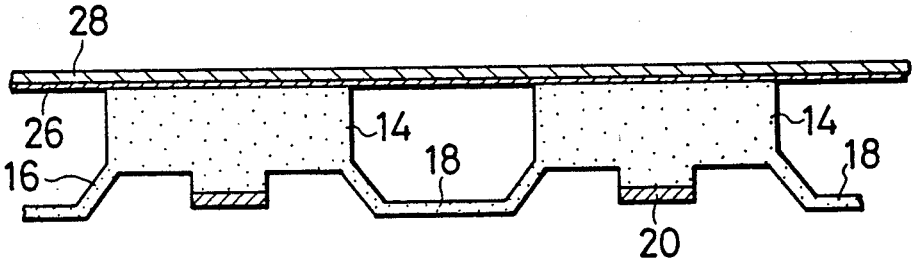
FIGS. 4 and 5 each are a fragmentary vertical sectional view showing the process of manufacturing another embodiment of a push button switch in accordance with the present invention.
Figure 5:
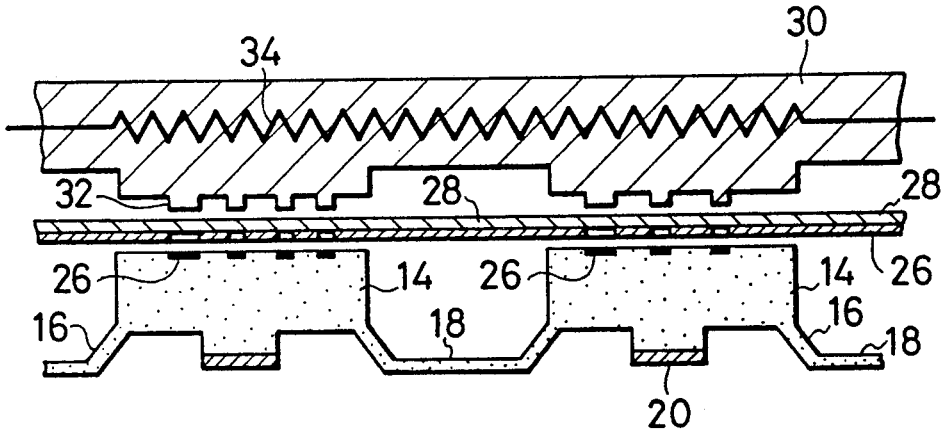

In accordance with another method of the present invention, the push button switch may be colored by sublimation transfer techniques, as shown in FIGS. 4 and 5. In these techniques, a plurality of push button switches 10, each having a key top 14, a dome section 16 and a leg section 18, are again formed integrally with one another by molding a silicone rubber material to form the switches into a rubber cover type of configuration. Subsequently, a film 26 of dye impregnated ink, formed by coating the ink on a release sheet 28 and drying it, is applied onto the upper surface of the key top 14 as shown in FIG. 4. A platen 30, provided with an engraved section 32 having a desired pattern, such as a letter, and a heater 34, is then pressed against the key top 14 through the outer surface of the release sheet 28, resulting in the penetration of the dye into the key top 14. Although such heat treatment causes the sublimation dye to transfer from the release sheet to the key top and penetrate therein, the vehicle resin in the dried film is not transferred, but rather remains on the release sheet. Thus, contrary to the wet printing process, no resin is deposited on the key tops by the sublimation transfer techniques.

Dye impregnated inks for use in the sublimation transfer techniques preferably include between about 1 wt % and about 15 wt % of a sublimation dye, and more preferably between about 3 wt % and about 10 wt % of such dye. The binder solution for such inks preferably comprises between about 3 wt % and about 30 wt % of a vehicle resin consisting of cellulose resins, alkyd resins, water-soluble acrylic resins, polyvinyl alcohols, polyamide resins, silicone resins and mixtures thereof, and more preferably between about 5 wt % and about 15 wt % of such vehicle resin. The binder solutions also preferably include between about 70 wt % and about 95 wt % of a solvent consisting of benzotriazole, ethanol, isopropyl alcohol, toluene, xylene, ethyl acetate, ethyl cellosolve, butyl cellosolve, water and mixtures thereof, and more preferably between about 80 wt % and about 90 wt % of such solvent.

The above-described sublimation transfer techniques may use the dye impregnated ink in solid form by drying the ink. More particularly, the ink may be used in the form of a coating or a dry film deposited on a substrate such as a plastic film or a special release paper (such as, for example, a condenser paper). The sublimation transfer technique may be practiced by placing such substrate on the upper surface of the rubber key top 14 and pressing the platen 30 onto the outer surface of the substrate. Such transfer may be accomplished within a temperature range of from about 100° C. to about 300° C., preferably from about 150° C. to about 230° C., and more preferably from about 180° C. to about 220° C.; at a pressure between about 0.1 $kgf/cm^2$ and about 1 $kgf/cm^2$ and preferably between about 0.1 $kgf/cm^2$ and about 0.2 $kgf/cm^2$; and for a time between about 0.5 seconds and about 60 minutes, preferably between about 15 seconds and about 5 minutes, and more preferably between about 20 seconds and about 60 seconds. Thus, the sublimation transfer techniques for coloring the push button switches can be performed more rapidly than the wet printing processes.

As can be seen from the foregoing, the push button switch of the present invention comprising the key top, dome section and leg section is first integrally made from a colorless or achromatic rubber material, and then the key top is colored in a desired pattern and color using suitable dye impregnating means. Thus, the present invention permits various kinds of push button switches having multi-color key tops to be readily manufactured in small lot sizes with good yields. Additionally, the use of coloring dyes having transparent properties provides the multi-color key tops with transparent properties. Furthermore, according to the present invention, the key tops may be printed with any desired pattern, such as a letter or the like, so that the coloring dye penetrates the key top and does not project out from the surface thereof, thus preventing the printed pattern from becoming worn and/or damaged on continued use. This significantly increases the degree of freedom in selecting the design of the key top.

The invention will be understood more readily with reference to the following examples; however, these examples are intended to illustrate the invention and are not to be construed to limit the scope of the invention.

EXAMPLE 1

Silicone rubber sold under the tradename "KE-961" from Shin-Etsu Chemical Co., Ltd., Japan was used for forming a plurality of push button switches of the rubber cover type, each including a key top. The silicone rubber "KE-961" had a formulation comprising a silicone rubber compound sold under the tradename "KE-961U" from Shin-Etsu Chemical Co., Ltd., and a peroxide or volcanizing agent sold under the tradename "C-8" from Shin-Etsu Chemical Co., Ltd., and was free of a coloring pigment and therefore milk white in color and transparent. A dye impregnated ink was then formed by combining 25 parts by weight (20 wt %) of an anthraquinone dye sold under the tradename "Resolin Bril Red" by Bayer AG with 100 parts by weight (80 wt %) of a binder solution. (The "Resolin Bril Red" anthraquinone dye could be replaced with an equal amount of an azo dye sold under the tradename "Resolin Red" by Bayer AG). The binder solution was composed of 8 parts by weight (6.4 wt %) of polyorganosiloxane, 20 parts by weight (16 wt %) of vinylsilicone resin and 40 parts by weight (32 wt %) of vinylsilicone oil, all as vehicle resins, and 0.01 parts by weight (0.01 wt %) of benzotriazole, 2 parts by weight (1.6 wt %) of ethanol and 30 parts by weight (24 wt %) of toluene, all as solvents. The dye impregnated ink was coated over the entire upper surface of the rubber key tops by wet screen printing, and then subjected to a heat treatment at a temperature of 200° C. for 10 minutes. This process caused the ink to penetrate into and color the whole key top.

EXAMPLE 2

A binder solution was prepared by combining 100 parts by weight of hydroxyethyl cellulose with 1,000 parts by weight of a mixed solvent consisting of ethyl cellosolve and isopropyl alcohol mixed at a ratio of 1:15 by weight, respectively. To this binder solution was added 100 parts by weight of a sublimation dye of Color Index Disperse Red 60 sold under the tradesman "Sumikaron RED-FBL" by Sumitomo Chemical Company, Ltd., Japan, to produce a dye impregnated ink having a red color. The ink was then coated on a 6 um thick polyester film using a gravure coater to form an ink ribbon having a dried coated film which was 2 um thick. A brass plate was etched to prepare a letter press having a heater incorporated under a rear surface thereof. The temperature of the letter press was adjusted so that the dried film of the ink ribbon would have a temperature of 200° C. and the ink ribbon was placed on the key top of each of the push button switches prepared as in Example 1, with the dried film facing the key tops. The letter press was then pressed against the ink ribbon with a pressure of 0.15 kgf/cm$^2$ for 20 seconds, thereby transferring a letter onto the upper surface of the key top and penetrated into the interior thereof, without leaving a raised surface deposit. Cutting the key top with a knife revealed that the ink had penetrated the key top to a depth of 30–40 um. The key top was then tapped at a load of 500 gf and at a rate of three times per second using a key hammer formed by trebly winding a medical gauze around a silicone ball having a diameter of 6 mm and a Shore hardness of 70 degrees. Although the key top was tapped 100 million times, the letter formed thereon was neither worn nor damaged.

It will thus be seen that the objects set forth above, among those made apparent from the preceding description, are efficiently attained and, since certain changes may be made in the above-construction without departing from the spirit and scope of the invention, it is intended that all matter contained in the above-description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

We claim:

1. A method for manufacturing a push button switch having an integrally formed key top, dome section and leg section, said method comprising the steps of:

molding said push button switch from a silicone rubber material, applying a dye impregnated ink to a surface of said key top by a wet printing process, said dye impregnated ink comprising between about 10 wt % and about 30 wt % of a sublimation dye selected from the group consisting of anthraquinone dyes, azo dyes and mixtures thereof, between about 40 wt % and about 70 wt % of a vehicle resin comprising a silicone resin, and between about 10 wt % and about 40 wt% of a solvent for dissolving said vehicle resin, and subjecting said dye impregnated ink to a heat treatment process which results in said sublimation dye penetrating below said surface of said key top, said heat treatment process being conducted at a temperature of between about 160° C. and about 220° C. and for a time of between about 10 minutes and about 30 minutes.

2. The method as claimed in claim 1 wherein said dye impregnated ink includes between about 15 wt % and about 25 wt % of said sublimation dye.

3. The method as claimed in claim 1 wherein said dye impregnated ink includes between about 50 wt % and about 60 wt % of said vehicle resin.

4. The method as claimed in claim 1 wherein said dye impregnated ink includes between about 20 wt % and about 30 wt % of said solvent.

5. The method as claimed in claim 1 wherein said heat treatment process is conducted at a temperature of between about 180° C. and about 200° C.

6. The method as claimed in claim 1 wherein said heat treatment process is conducted for a time of between about 10 minutes and about 15 minutes.

7. The method as claimed in claim 1 wherein at least a portion of said vehicle resin is selected from the group consisting of polyorganosiloxane, vinylsilicone resin, vinylsilicone oil, and mixtures thereof.

8. A method for manufacturing a key pad including a plurality of integrally connected push button switches, each of said push button switches having an integrally formed key top, dome section and leg section, said method comprising the steps of:

molding said key pad from a silicone rubber material, applying a dye impregnated ink to a surface of each of said key tops by a wet printing process, said dye impregnated ink comprising between about 10 wt % and about 30 wt % of a sublimation dye selected from the group consisting of anthraquinone dyes, azo dyes and mixtures thereof, between about 40 wt % and about 70 wt % of a vehicle resin comprising a silicone resin, and between about 10 wt % and about 40 wt % of a solvent for dissolving said vehicle resin, and subjecting said dye impregnated ink to a heat treatment process which results in said sublimation dye penetrating below said surfaces of said key tops, said heat treatment process being conducted at a temperature of between about 160° C. and about 220° C. and for a time of between about 10 minutes and about 30 minutes.

9. The method as claimed in claim 8 wherein said dye impregnated ink includes between about 15 wt % and about 25 wt % of said sublimation dye.

10. The method as claimed in claim 8 wherein said dye impregnated ink includes between about 50 wt % and about 60 wt % of said vehicle resin.

11. The method as claimed in claim 8 wherein said dye impregnated ink includes between about 20 wt % and about 30 wt % of said solvent.

12. The method as claimed in claim 8 wherein said heat treatment process is conducted at a temperature of between about 180° C. and about 200° C.

13. The method as claimed in claim 8 wherein said heat treatment process is conducted for a time of between about 10 minutes and about 15 minutes.

14. The method as claimed in claim 8 wherein at least a portion of said vehicle resin is selected from the group consisting of polyorganosiloxane, vinyl silicone resin, vinyl silicone oil, and mixtures thereof.

15. A key pad including a plurality of integrally connected push button switches, each of said push button switches having an integrally formed key top, dome section and leg section, said key pad produced by the method of claim 8.

16. A method for manufacturing a push button switch having an integrally formed key top, dome section and leg section, said method comprising the steps of:

molding said push button switch from a silicone rubber material, providing a sublimation transfer sheet consisting of a dried film of a dye impregnated ink adhered to a release sheet, wherein said dye impregnated ink, before drying, comprises between about 1 wt % and about 15 wt % of a sublimation dye, between about 3 wt % and about 30 wt % of a vehicle resin selected from the group consisting of cellulose resins, alkyd resins, water-soluble acrylic resins, polyvinyl alcohols, polyamide resins, silicone resins, and mixtures thereof, and between about 70 wt % and about 95 wt % of a solvent for dissolving said vehicle resin, and contacting a surface of said key top with said film on said sublimation transfer sheet while subjecting said sublimation transfer sheet to a heat treatment process which results in said sublimation dye penetrating below said surface of said key top, said heat treatment process being conducted at a temperature of between about 150° C. and about 230° C., at a pressure of between about 0.1 kgf/cm$^2$ and about 1.0 kgf/cm$^2$, and for a time of between about 15 seconds and about 5 minutes.

17. The method as claimed in claim 16 wherein said dye impregnated ink includes between about 3 wt % and about 10 wt % of said sublimation dye.

18. The method as claimed in claim 16 wherein said dye impregnated ink includes between about 5 wt % and about 15 wt % of said vehicle resin.

19. The method as claimed in claim 16 wherein said dye impregnated ink includes between about 80 wt % and about 90 wt % of said solvent.

20. The method as claimed in claim 16 wherein said heat treatment process is conducted at a temperature of between about 180° C. and about 220° C.

21. The method as claimed in claim 15 wherein said heat treatment process is conducted at a pressure of between about 0.1 kgf/cm$^2$ and about 0.2 kgf/cm$^2$.

22. The method as claimed in claim 16 wherein said heat treatment process is conducted for a time of between about 20 seconds and about 60 seconds.

23. A push button switch having an integrally formed key top, dome section and leg section produced by the method of claim 16.

24. A method for manufacturing a key pad including a plurality of integrally connected push button switches, each of said push button switches having an integrally formed key top, dome section and leg section, said method comprising the steps of:

molding said key pad from a silicone rubber material, providing a sublimation transfer sheet consisting of a dried film of a dye impregnated ink adhered to a release sheet, wherein said dye impregnated ink, before drying, comprises between about 1 wt % and about 15 wt % of a sublimation dye, between about 3 wt % and about 30 wt % of a vehicle resin selected from the group consisting of cellulose resins, alkyd resins, water-soluble acrylic resins, polyvinyl alcohols, polyamide resins, silicone resins, and mixtures thereof, and between about 70 wt % and about 95 wt % of a solvent for dissolving said vehicle resin, and contacting a surface of each of said key tops with said film on said sublimation transfer sheet while subjecting said sublimation transfer sheet to a heat treatment process which results in said sublimation dye penetrating below said surfaces of said key tops, said heat treatment process being conducted at a temperature of between about 150° C. and about 230° C., at a pressure of between about 0.1 kgf/cm$^2$ and about 1.0 kgf/cm$^2$, and for a time of between about 15 seconds and about 5 minutes.

25. The method as claimed in claim 22 wherein said dye impregnated ink includes between about 3 wt % and about 10 wt % of said sublimation dye.

26. The method as claimed in claim 22 wherein said dye impregnated ink includes between about 5 wt % and about 15 wt % of said vehicle resin.

27. The method as claimed in claim 22 wherein said dye impregnated ink includes between about 80 wt % and about 90 wt % of said solvent.

28. The method as claimed in claim 22 wherein said heat treatment process is conducted at a temperature of between about 180° C. and about 220° C.

29. The method as claimed in claim 22 wherein said heat treatment process is conducted at a pressure of between about 0.1 kgf/cm$^2$ and about 0.2 kgf/cm$^2$.

30. The method as claimed in claim 22 wherein said heat treatment process is conducted for a time of between about 20 seconds and about 60 seconds.

31. A push button switch having an integrally formed key top, dome section and leg section produced by the method of claim 1.

32. A key pad including a plurality of integrally connected push button switches, each of said push button switches having an integrally formed key top, dome section and leg section, said key pad produced by the method of claim 24.

* * * * *

UNITED STATES PATENT AND TRADEMARK OFFICE

CERTIFICATE OF CORRECTION

PATENT NO. : 5,270,507

DATED : December 14, 1993

INVENTOR(S) : Nakamura et al.

It is certified that error appears in the above-identified patent and that said Letters Patent is hereby corrected as shown below:

Column 11, line 29, "15" should read --16--.

Column 12, line 20, "22" should read --24--.

Column 12, line 23, "22" should read --24--.

Column 12, line 26, "22" should read --24--.

Column 12, line 29, "22" should read --24--.

Column 12, line 32, "22" should read --24--.

Column 12, line 35, "22" should read --24--.

Signed and Sealed this

Seventeenth Day of May, 1994

Bruce Lehman

*Attest:*

BRUCE LEHMAN

*Attesting Officer*

*Commissioner of Patents and Trademarks*